US010173227B2

(12) United States Patent
Eliasson et al.

(10) Patent No.: US 10,173,227 B2
(45) Date of Patent: Jan. 8, 2019

(54) DISC STACK CENTRIFUGAL SEPARATOR WITH SEALING ARRANGEMENT

(71) Applicant: ALFA LAVAL CORPORATE AB, Lund (SE)

(72) Inventors: Thomas Eliasson, Älvsjö (SE); Per Fonser, Enskededalen (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 15/543,339

(22) PCT Filed: Jan. 21, 2016

(86) PCT No.: PCT/EP2016/051227
§ 371 (c)(1),
(2) Date: Jul. 13, 2017

(87) PCT Pub. No.: WO2016/124412
PCT Pub. Date: Aug. 11, 2016

(65) Prior Publication Data

US 2018/0008991 A1 Jan. 11, 2018

(30) Foreign Application Priority Data

Feb. 6, 2015 (EP) ..... 15154067

(51) Int. Cl.
*B04B 9/12* (2006.01)
*B04B 1/08* (2006.01)
*B04B 7/14* (2006.01)

(52) U.S. Cl.
CPC *B04B 9/12* (2013.01); *B04B 1/08* (2013.01); *B04B 7/14* (2013.01)

(58) Field of Classification Search
CPC .. B04B 15/00; B04B 9/04; B04B 9/12; B04B 9/00; B04B 15/02; B04B 9/02;
(Continued)

(56) References Cited

U.S. PATENT DOCUMENTS 3,601,307 A 8/1971 Shapiro
4,447,062 A 5/1984 Leicht
(Continued)

FOREIGN PATENT DOCUMENTS

CN 1343138 A 4/2002
CN 101062489 A 10/2007
(Continued)

OTHER PUBLICATIONS

International Search Report, issued in PCT/EP2016/051227, dated Oct. 26, 2016.
(Continued)

*Primary Examiner* — Charles Cooley
(74) *Attorney, Agent, or Firm* — Birch, Stewart, Kolasch & Birch, LLP

(57) ABSTRACT

A centrifugal separator includes a housing, a spindle, and a rotor. The spindle is only journaled in a bearing arrangement fixedly positioned in the housing at the first axial end portion. The centrifugal separator includes a seal arranged between the spindle and the housing. The seal is arranged at a distance from the bearing arrangement where the spindle is subjected to deflection. The seal includes a cylindrical inner surface associated with the housing, a circular slot in the spindle or in a rotating member associated with the spindle, and a piston ring arranged in the slot and abutting against the cylindrical inner surface.

19 Claims, 3 Drawing Sheets

(58) Field of Classification Search
CPC .. B04B 9/06; B04B 7/02; B04B 13/00; B04B 1/08; B04B 7/14; F16J 15/34
USPC ..... 494/41
See application file for complete search history.

(56) References Cited

U.S. PATENT DOCUMENTS

| | | | | |
|---|---|---|---|---|
| 4,654,023 | A * | 3/1987 | Foldhazy | B04B 9/12 277/362 |
| 5,364,245 | A | 11/1994 | Kriehn et al. | |
| 5,863,317 | A | 1/1999 | Smith et al. | |
| 5,904,356 | A | 5/1999 | Mundy | |
| 6,676,131 | B1 | 1/2004 | Hedin | |
| 7,008,194 | B2 | 3/2006 | Frankenstein | |
| 7,998,051 | B2 | 8/2011 | Klintenstedt | |
| 8,038,592 | B2 * | 10/2011 | Toi | B04B 5/0442 494/14 |
| 10,016,767 | B2 * | 7/2018 | Spiegel | B04B 15/00 |
| 2009/0140495 | A1 | 6/2009 | Dreifert et al. | |
| 2009/0197752 | A1 * | 8/2009 | Spiegel | B04B 7/02 494/7 |
| 2015/0202635 | A1 * | 7/2015 | Spiegel | B04B 15/00 494/14 |
| 2018/0008991 | A1 * | 1/2018 | Eliasson | B04B 9/12 |

FOREIGN PATENT DOCUMENTS

| | | | | |
|---|---|---|---|---|
| CN | 101062490 | A | 10/2007 | |
| CN | 101506552 | A | 8/2009 | |
| CN | 102287533 | A | 12/2011 | |
| DE | 20 2005 014 353 | U1 | 1/2007 | |
| EP | 1 394 451 | B1 | 1/2007 | |
| EP | 1849525 | A2 * | 10/2007 | B04B 9/12 |
| GB | 871524 | | 6/1961 | |
| JP | 2002-273268 | A | 9/2002 | |

OTHER PUBLICATIONS

Written Opinion of the International Searching Authority, issued in PCT/EP2016/051227, dated Oct. 26, 2016.
Chinese Office Action and Search Report, dated Sep. 21, 2018 for Chinese Application No. 201680008976.0, with an English machine translation of the Chinese Office Action.

* cited by examiner

DISC STACK CENTRIFUGAL SEPARATOR WITH SEALING ARRANGEMENT

TECHNICAL FIELD

The present invention relates to a disc stack centrifugal separator comprising a spindle and a seal arranged around the spindle.

BACKGROUND

A disc stack centrifugal separator comprises a rotor which is connected to a spindle being driven by a drive arrangement including e.g. an electric motor. Inside the rotor there is a separation space wherein a stack of frustoconical separation discs is arranged. A fluid feed mixture is fed into the separation space and the disc stack, and is separated into at least a light fluid phase and a heavy fluid phase during rotation of the rotor. The light and heavy fluid phases may be continuously led out of the rotor.

The spindle is commonly vertically arranged in a housing of the centrifugal separator. The spindle is journalled in the housing at a first axial end portion of the spindle and the rotor is connected to a second axial end portion of the spindle. The spindle is journalled at the first axial end portion in a bearing arrangement fixedly positioned in the housing. Although the spindle may be journalled at further positions along the spindle, the bearing arrangement is the only journalling of the spindle, which is fixed in relation to the housing.

The spindle extends through two or more spaces of the housing from the bearing arrangement to the rotor. Ideally, the different spaces are sealed from each other and various sealing arrangements have been tried over time. However, three aspects complicate sealing along the spindle of a disc stack centrifugal separator. The spindle with the rotor are rotated at supercritical speed, the above-mentioned fixed journalling at only one axial end portion of the spindle, and the high peripheral speed of the spindle.

Together with the bearing arrangement being fixedly journalled at only one end portion of the spindle, the super critical speed causes a deflection of the spindle. Thus, the spindle is not centred along a straight axis but may deflect up to several millimeters at one or more positions along the spindle. The amount of deflection depends e.g. on centrifugal separator size, rotor weight, and spindle dimensions. The high peripheral speed causes damage to rubber or polymer materials abutting against the spindle. Thus, the use of an elastic sealing element abutting against the spindle and following any deflection of the spindle cannot be used. For instance, an ordinary simmering seal may be used up to approximately 12 m/s peripheral speed. A seal comprising PTFE be used up to approximately 30 m/s peripheral speed, but will not withstand radial movement of the spindle at such high peripheral speed. the peripheral speed at a spindle of a centrifugal separator may be up to 50 m/s or more.

One known type of sealing element used around a spindle between two spaces of a housing of a disc stack centrifugal separator comprises a U-shaped PTFE ring. The PTFE ring extends around the spindle with space between the PTFE ring and the spindle, such that the deflecting spindle does not come into contact with the PTFE ring. Although the narrow space between the PTFE ring and the spindle provides sealing to a certain degree, some transfer of fluid along the spindle between the two spaces of the housing may still occur.

SUMMARY

It is an object of the present invention to provide a disc stack centrifugal separator with an efficient seal around its spindle.

According to an aspect of the invention, the object is achieved by a disc stack centrifugal separator for separating a light fluid phase and a heavy fluid phase from a fluid feed mixture. The centrifugal separator comprises a housing, a spindle, and a rotor, wherein the spindle is journalled in the housing at a first axial end portion of the spindle and the rotor is connected to a second axial end portion of the spindle. The spindle is only journalled in a bearing arrangement fixedly positioned in the housing at the first axial end portion. The centrifugal separator comprises a seal arranged between the spindle and the housing. The seal is arranged at a distance from the bearing arrangement where the spindle is subjected to deflection. The seal comprises a cylindrical inner surface associated with the housing, a circular slot in the spindle or in a rotating member associated with the spindle, and a piston ring arranged in the slot and abutting against the cylindrical inner surface.

Since the seal comprises a piston ring arranged in the slot and abutting against the cylindrical inner surface, a seal between the spindle and the housing withstanding deflection of the spindle is provided. As a result, the above mentioned object is achieved.

The disc stack centrifugal separator, which hereinafter also may be referred to as a centrifugal separator, may be driven by a drive arrangement e.g. comprising an electric motor and a transmission, which may comprise a belt drive and/or gears, or comprising a motor directly mounted on the spindle. That is, the spindle and the rotor connected thereto are rotated by the drive arrangement about a rotation axis. Inside the rotor there is a separation space wherein a stack of frustoconical separation discs is arranged. The fluid feed mixture may comprise at least two immiscible fluid phases (gas and/or liquid) and also optionally solid matter. Thus, according to some embodiments, the fluid feed mixture may be separated not only into a light and a heavy fluid phase but also into sludge containing solid matter, during rotation of the rotor.

The spindle may be vertically arranged in the housing. The spindle being only journalled in a bearing arrangement fixedly positioned in the housing at the first axial end portion entails that the spindle may be supported or journalled at further points along its extension. However, such supports or journals are in such case resiliently positioned in the housing. Put differently, the bearing arrangement is the only journalling of the spindle, which is fixed in relation to the housing.

The piston ring may be made from a metallic material. The piston ring may be of the kind used in combustion engines for sealing a piston against a cylinder bore. The piston ring may comprise a slit, e.g. a radial slit, to permit the piston ring to be mounted in the slot. The slot may have a smaller inner diameter than the piston ring. The slot may be wider in an axial direction of the spindle than the piston ring. The piston ring may be resilient and biased outwardly against the cylindrical inner surface.

The seal may be arranged between two spaces of the housing. One of the spaces may be a space communicating with an ambient environment of the centrifugal separator.

According to embodiments, the housing may comprise a conical surface adjacent to the cylindrical inner surface. In this manner the seal may be easily assembled. The piston ring is arranged in the slot in the spindle or the rotating member prior to inserting the spindle in the housing. As the spindle is inserted in the housing, the piston ring abuts against the conical surface and is compressed as the piston ring slides along the conical surface into the cylindrical inner surface as the spindle is further inserted into the housing reaching its final axial position.

According to embodiments, the rotating member associated with the spindle may comprise a pulley, and the slot may be provided in the rotating member. In this manner the seal may be provided in connection with a pulley of a drive arrangement of the centrifugal separator.

According to embodiments, the seal may be provided adjacent to the second axial end portion of the spindle. In this manner the seal may seal a rotor space enclosing the rotor from other portions of the housing along the spindle.

According to embodiments, the seal may be provided adjacent to a drainage space inside the housing, the drainage space surrounding the spindle and being arranged adjacent to a rotor space inside the housing enclosing the rotor. In this manner the drainage space may be sealed along the spindle.

According to embodiments, the spindle may be configured to be rotated at supercritical speed.

According to embodiments, the centrifugal separator may comprise more than one seal of the same kind according to aspects and/or embodiments disclosed herein.

According to embodiments the centrifugal separator may be configured for use aboard a floating vessel. The centrifugal separator may for instance be used for separating oil from bilge water, for cleaning heavy fuel oil to be used in a combustion engine, for cleaning of lubricating oil, etc. According to alternative embodiments, the centrifugal separator may be configured for use in one or more of other applications where centrifugal separators are commonly used.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
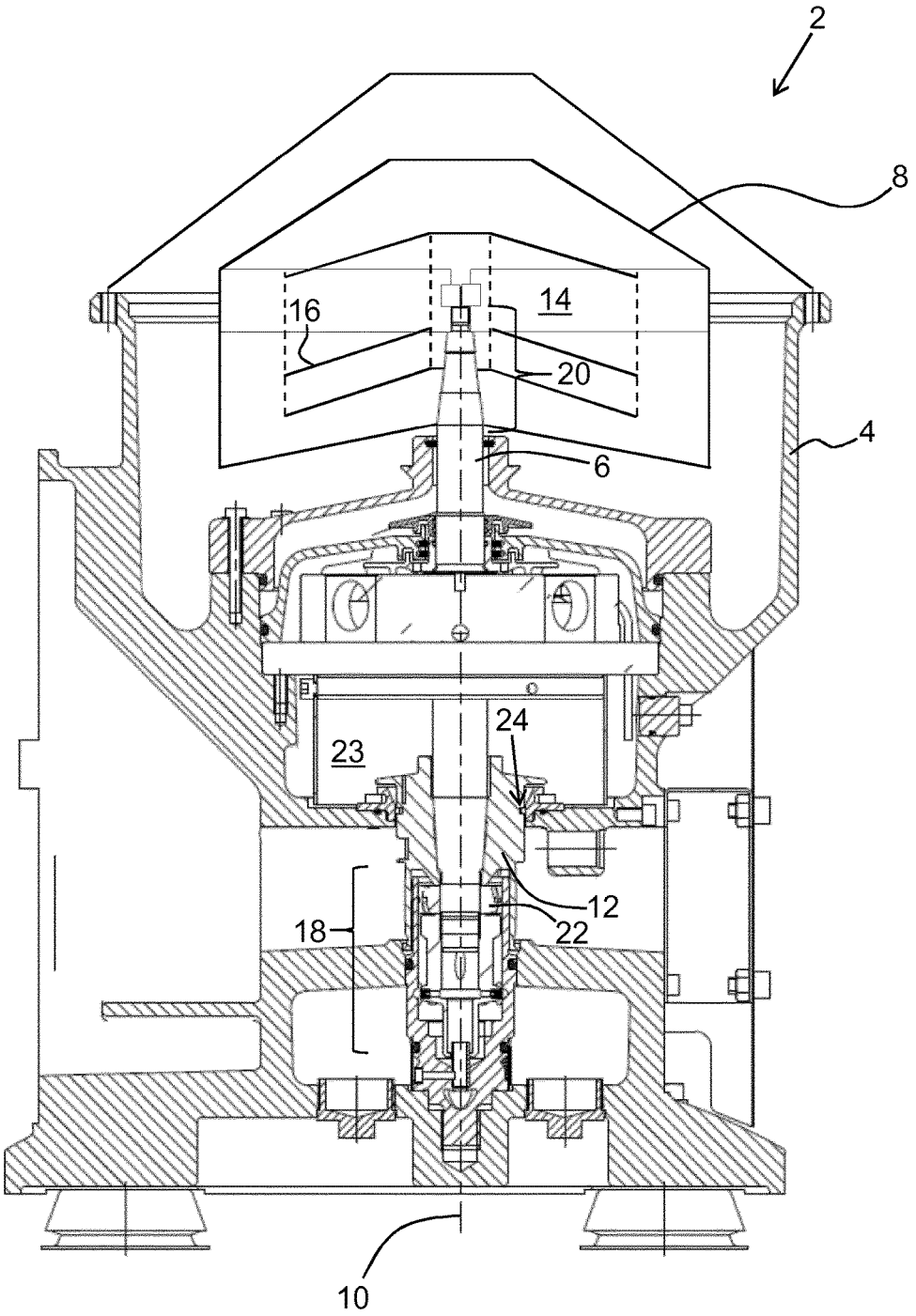
FIG. 1 illustrates a cross section through a disc stack centrifugal separator according to embodiments.

FIG. 1 illustrates a cross section through a disc stack centrifugal separator 2 according to embodiments. The centrifugal separator 2 comprises a housing 4, a spindle 6, and a rotor 8 (schematically shown). The housing 4 may comprise more than one individual part and thus, may be assemble from several parts. A drive arrangement of the centrifugal separator 2 is configured to rotate the spindle 6 and the rotor 8 at supercritical speed about a rotation axis 10. In these embodiments the drive arrangement comprises an electric motor (not shown) and a belt drive comprising a pulley 12 connected to the spindle 6. Inside the rotor 6 there is a separation space 14 wherein a stack of frustoconical separation discs 16 is arranged. The centrifugal separator 2 is configured for separating a light fluid phase and a heavy fluid phase from a fluid feed mixture. The inlet for the fluid feed mixture and outlets or the separated phases have been omitted in FIG. 1.

In these embodiments the spindle 6 is substantially vertically arranged in the housing 4. The spindle 6 is journalled in the housing 4 at a first axial end portion 18 of the spindle 6, i.e. in these embodiments the lower end portion of the spindle 6. The rotor 8 is connected to a second axial end portion 20 of the spindle 6, i.e. in these embodiments the upper end portion of the spindle 6. In other embodiments the rotor may be suspended at the lower end portion of the spindle, and the spindle may be journalled at the upper end portion thereof.

The spindle 6 is only journalled in a bearing arrangement 22 fixedly positioned in the housing at the first axial end portion 18. In these embodiments the bearing arrangement 22 comprises one spherical roller bearing. In these embodiments the spindle 6 is journalled also below the second axial end portion 20. As opposed to the journalling at the first axial end portion 18, the journalling below the second axial end portion 20 comprises a bearing which is resiliently positioned in the housing 4 to permit deflection of the second axial end portion 20. In alternative embodiments, the bearing arrangement 22 may comprise more than one bearing, e.g. two, three, or more bearings.

The centrifugal separator 2 comprises a seal 24 arranged between the spindle 6 and the housing 4. The seal 24 will be discussed in detail with reference to FIGS. 2*a* and 2*b*. In these embodiments the seal 24 is arranged adjacent to a first space 23 inside the housing 4. The first space 23 surrounds the spindle 6 and is configured to contain an oil mist during operation of the centrifugal separator 2. In this manner the seal 24 may prevent the oil mist and oil from escaping the first space 23 along the spindle 6.

In other embodiment, the seal 24 may be arranged at other positions around the spindle 6 to seal off two spaces of the housing 4 from each other. According to further embodiments, the centrifugal separator 2 may comprise more than one seal 24 of the kind disclosed herein.

Figure 2A:
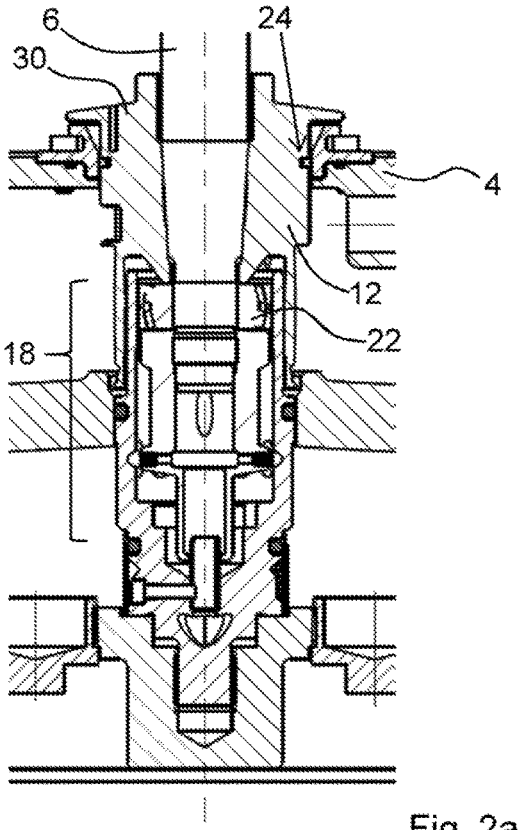
FIGS. 2*a* and 2*b* illustrate details of a spindle and a seal of the centrifugal separator of FIG. 1.
Figure 2B:
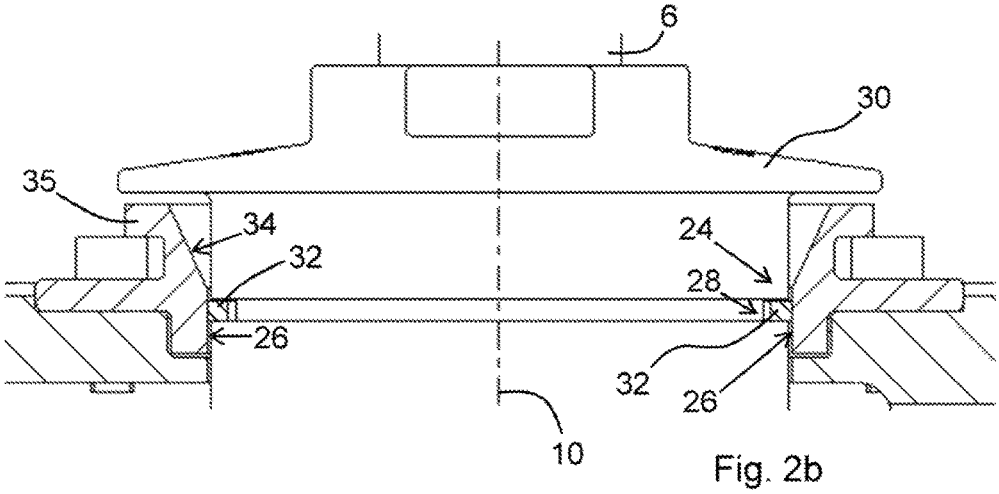

FIGS. 2*a* and 2*b* illustrate details of the spindle 6 and the seal 24 of the centrifugal separator of FIG. 1. Referring to FIG. 2*a*, the seal 24 is arranged at a distance from the bearing arrangement 22 where the spindle 6 is subjected to deflection due to the spindle 6 only being fixedly positioned in the housing 4 at its first axial end portion 18. Such deflection may be within a range of 0.1 mm up to 5 mm or more, depending e.g. on the distance from the bearing arrangement 22 and the dimensions of the spindle 6. The distance between the seal 24 and the bearing arrangement 22 may be e.g. 50 mm or more. In embodiments having a bearing arrangement 22 comprising more than one bearing, the seal 24 is arranged at a distance from that bearing of the more than one bearings, which is closest to the seal 24.

Referring to FIG. 2*b*, the seal 24 comprises a cylindrical inner surface 26 associated with the housing 4, a circular slot 28 in a rotating member 30 associated with the spindle 6, and a piston ring 32 arranged in the slot 28 and abutting against the cylindrical inner surface 26. The circular slot 28 has a top surface, a bottom surface and an inner surface. A distance between the top surface and a bottom surface defines a height of the slot. The piston ring 32 is in the slot and has a top wall, a bottom wall, an inner wall extending between the top wall and bottom wall and an outer wall extending between the top wall and bottom wall. A distance between the top wall and a bottom wall defining a height of the piston ring. The height of the piston ring is less than the height of the slot so that the piston ring fits within the slot. The inner surface of the ring is radially spaced outwardly from the inner surface of the slot, as seen in FIG. 2*b*. The rotating member 30 associated with the spindle 6 comprises in these embodiments the pulley 12 of the drive arrangement. The circular slot 28 is provided in the rotating member 30. In other embodiments the circular slot is provided in the spindle as such.

The piston ring 32 is stationary in a rotational direction of the spindle 6, and the piston ring 32 is axially movable along the cylindrical inner surface 26. Thus, the piston ring 32 is subjected to a rotational relative movement only in relation to the spindle 6, and not in relation to the cylindrical surface 26 during use of the centrifugal separator. Rotational relative movement between the piston ring 32 and the rotating member 30 takes place in the circular slot 28. The axial movability of the piston ring 32 along the cylindrical inner surface 26 permits easy assembly of the seal 24, and during use of the centrifugal separator, an axial displacement between the spindle 6 and the cylindrical inner surface 26. Such axial displacement may occur e.g. due to discharge of a sludge phase from the rotor 8 or during heavy sea when the centrifugal separator is used aboard a floating vessel.

The slot 28 has a radial depth, which permits the piston ring 32 to be arranged in the slot 28 with a radial play permitting the spindle 6 to deflect radially without putting any strain on the seal 26 when the piston ring 32 abuts against the cylindrical inner surface 26. Accordingly, the radial play suitably is slightly larger than the deflection of the spindle 6 at the seal 24. The piston ring 32 may be made e.g. from cast iron. The piston ring 32 may be of the kind used in combustion engines for sealing a piston against a cylinder bore. The piston ring 32 may have a radial thickness of e.g. 3-12 mm and axial height of e.g. 2-8 mm. The piston ring 32 may be resilient, biased radially outwardly towards the cylindrical inner surface 26 to ensure a reliable abutment and sealing against the cylindrical inner surface 26. Thus, in an unassembled state, the piston ring 32 has a lager larger diameter than the cylindrical inner surface 26. The piston ring 32 may be configured for being easily positionable in the slot 28. Thus, the piston ring 32 may comprise e.g. a radial slit, or a radial slit inclined in relation to the rotation axis, or a slit comprising at least two overlapping steps seen in an axial direction, or the piston ring 32 may comprise two or more abutting helical turns. The slot 28 is wider in an axial direction of the spindle 6 than the piston ring 32 to permit relative rotation between the piston ring 32 and the rotating member 30. Mentioned purely as an example, the slot 28 may be 0.05-0.2 mm wider in the axial direction than the piston ring 32.

The housing 4 comprises a conical surface 34 adjacent to the cylindrical inner surface 26. As discussed above, this facilitates assembly of the seal 24. The conical surface 34 connects to the cylindrical inner surface 26. Thus, the piston ring 32 may slide along the conical surface 34 into the cylindrical inner surface 26 during assembly of the seal 24. The conical surface 34 is provided in a separate part 35 of the housing 4. Mentioned purely as an example, the conical surface 34 may extend at an angle within a range of e.g. 10-45 degrees to the rotation axis 10 of the spindle 6. In the illustrated embodiments the conical surface 34 extends at an angle at 25 degrees to the rotation axis 10 of the spindle 6.

Mentioned purely as an example, a centrifugal separator 2 having a hydraulic capacity of 5.5 $m^3$/h, and comprising a rotor 8 being driven at 12000 rpm, a spindle having a diameter of approximately 30 mm, and a rotating member 30 having a diameter of approximately 80 mm at the seal 24 may have a distance between an upper bearing of the bearing arrangement 22 and the seal 24 of approximately 60 mm. In such a centrifugal separator the maximum radial deviation at the seal 24 as the spindle 6 passes the critical speed is approximately 1 mm, and the radial deviation at supercritical speed at the seal 24 is approximately 0.1 mm. Accordingly, a radial play of the piston ring 32 in the slot 28 may be 1.2 mm to permit the spindle 6 passing the critical speed without damaging the seal 24.

Again, mentioned purely as an example, a centrifugal separator 2 having a hydraulic capacity of 38 $m^3$/h, and comprising a rotor 8 being driven at 5300 rpm, a spindle 6 having a diameter of approximately 70 mm, and a rotating member 30 having a diameter of approximately 165 mm at the seal 24 may have a distance between an upper bearing of the bearing arrangement 22 and the seal 24 of approximately 90 mm. In such a centrifugal separator the maximum radial deviation at the seal 24 as the spindle 6 passes the critical speed is approximately 1.5 mm, and the radial deviation at supercritical speed at the seal 24 is approximately 0.3 mm. Accordingly, a radial play of the piston ring 32 in the slot 28 may be 1.7 mm to permit the spindle 6 passing the critical speed without damaging the seal 24.

Figure 3:
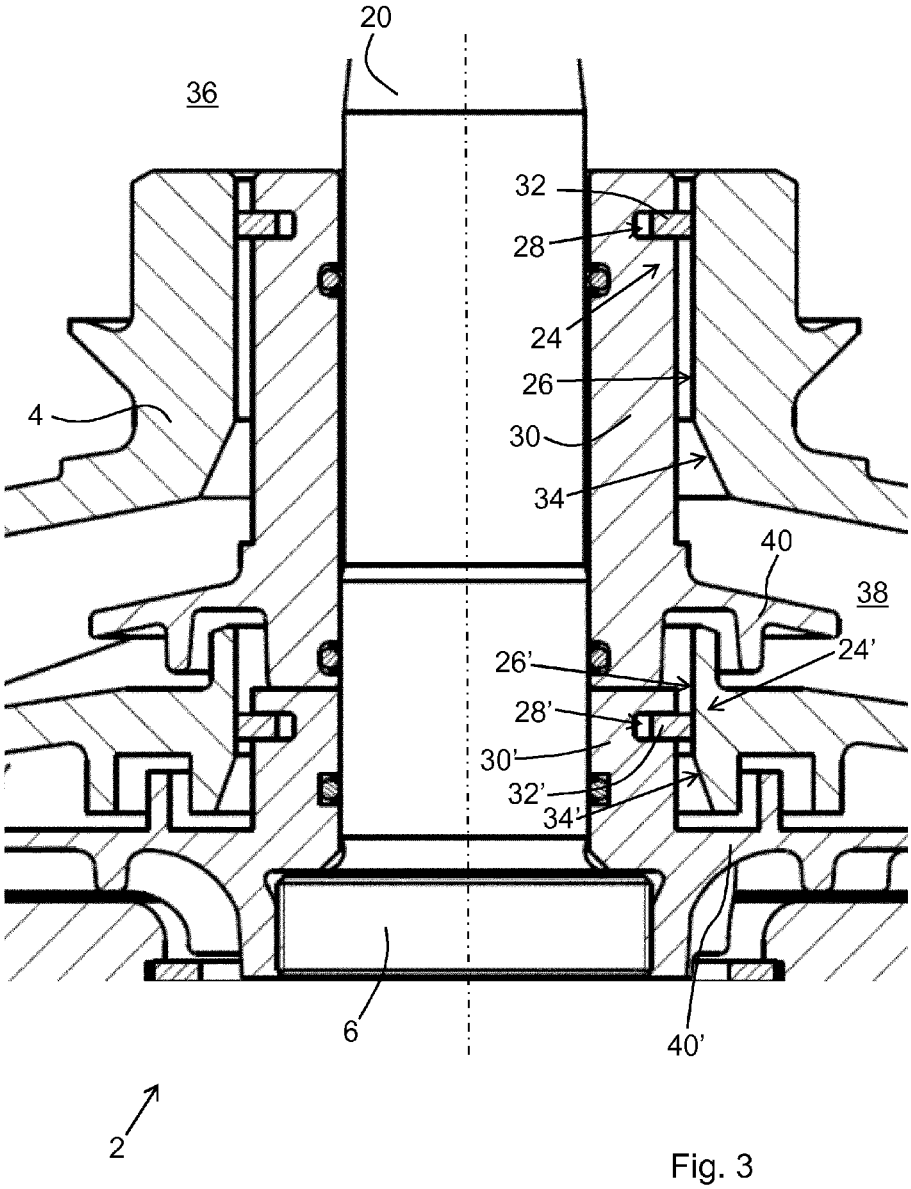
FIG. 3 illustrates details of a spindle of a disc stack centrifugal separator according to embodiments.

FIG. 3 illustrates details of a spindle 6 of a disc stack centrifugal separator 2 according to embodiments. The centrifugal separator 2 is of the same kind as of the embodiments of FIG. 1. In these embodiments, a seal 24 of the kind discussed in connection with FIG. 2*b* is provided adjacent to the second axial end portion 20 of the spindle 6. Moreover, in these embodiments the centrifugal separator 2 comprises two seals 24, 24' of the kind discussed in connection with FIG. 2*b*.

A first seal 24 seals a rotor space 36 from a drainage space 38 below the rotor space 36 along the spindle 6. The rotor space 36 is formed in the housing 4 and encloses the rotor (not shown). The drainage space 38 may be provided to collect leaking fluid from the rotor space 36 to safely drain such fluid instead of the fluid contaminating remaining spaces of the housing 4. Thus, the first seal 24 is provided adjacent to the drainage space 38. A second seal 24' is provided around the spindle 6 opposite to the first seal 24. Thus, the drainage space 38 may be sealed from leakage into lower spaces of the housing 4.

Again each of the seals 24, 24' comprises a cylindrical inner surface 26, 26' associated with the housing 4, a circular slot 28, 28' in a rotating member 30, 30' associated with the spindle 6, and a piston ring 32, 32' arranged in the slot 28, 28' and abutting against the cylindrical inner surface 26, 26'. The slot 28, 28' is provided in the rotating member 30, 30'. Each of the rotating members 30, 30' associated with the spindle 6 comprises in these embodiments a flange 40, 40'. Again, the housing 4 comprises a conical surface 34 adjacent to the cylindrical inner surface 26 to facilitate assembly of the seal 24, 24'. The conical surface 34 are provided in separate parts of the housing 4, which separate parts are assembled after the spindle 6 has been placed in the housing 4 and the bearing arrangement at the first axial end portion of the spindle 6.

This invention should not be construed as limited to the embodiments set forth herein. A person skilled in the art will realize that different features of the embodiments disclosed herein may be combined to create embodiments other than those described herein, without departing from the scope of the present invention, as defined by the appended claims.

Although the invention has been described with reference to example embodiments, many different alterations, modifications and the like will become apparent for those skilled in the art. A centrifugal separator may for instance comprise only one of the seals 24, 24' of the embodiments shown in FIG. 3. A centrifugal separator according to further embodiments may comprise one or both of the seals 24, 24' shown in FIG. 3 as well as a seal as shown in FIGS. 1-2*b*. Therefore, it is to be understood that the foregoing is illustrative of various example embodiments and that the invention is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A disc stack centrifugal separator for separating a light fluid phase and a heavy fluid phase from a fluid feed mixture, the centrifugal separator comprising:

a housing;

a spindle in the housing;

a rotor attached to a top of the spindle;

a circular slot in the spindle, the circular slot having a top surface, a bottom surface and an inner surface, a distance between the top surface and a bottom surface defining a height of the slot;

a piston ring in the slot, the piston ring having a top wall, a bottom wall, an inner wall extending between the top wall and bottom wall and an outer wall extending between the top wall and bottom wall, a distance between the top wall and a bottom wall defining a height of the piston ring, wherein the piston ring fits within the slot, wherein the spindle is journaled in the housing at a first axial end portion of the spindle and the rotor is connected to a second axial end portion of the spindle, wherein the spindle is only journaled in a bearing arrangement fixedly positioned in the housing at the first axial end portion, wherein the piston ring is arranged at a distance from the bearing arrangement where the spindle is subjected to deflection.

2. The disc stack centrifugal separator according to claim 1, wherein the piston ring is stationary in a rotational direction of the spindle, and wherein the piston ring is axially movable along the cylindrical inner surface.

3. The disc stack centrifugal separator according to claim 1, wherein the piston ring is resilient and is biased outwardly against the cylindrical inner surface.

4. The disc stack centrifugal separator according to claim 1, wherein the rotating member comprises a pulley, and wherein the slot is provided in the rotating member.

5. The disc stack centrifugal separator according to claim 1, wherein the piston ring is arranged adjacent to a first space inside the housing, the first space surrounding the spindle and being configured to contain an oil mist during operation of the centrifugal separator.

6. The disc stack centrifugal separator according to claim 1, wherein the piston ring is provided adjacent to the second axial end portion of the spindle.

7. The disc stack centrifugal separator according to claim 1, wherein the piston ring is provided adjacent to a drainage space inside the housing, the drainage space surrounding the spindle and being arranged adjacent to a rotor space inside the housing.

8. The disc stack centrifugal separator according to claim 1, wherein the centrifugal separator comprises more than one of said seal circular slot and piston ring.

9. The disc stack centrifugal separator according to claim 1, wherein a diameter of the piston ring is greater than a diameter of the spindle.

10. The disc stack centrifugal separator according to claim 1, wherein the spindle includes a rotating member, and wherein the slot is in the rotating member.

11. The disc stack centrifugal separator according to claim 1, wherein the inner surface of the piston ring is spaced radially outwardly from the inner surface of the slot.

12. The disc stack centrifugal separator according to claim 1, wherein the housing has a cylindrical inner surface and an outer surface, wherein the piston ring contacts the inner surface of the housing, and wherein the piston ring has a diameter that is larger than a diameter of the cylindrical inner surface of the housing.

13. The disc stack centrifugal separator according to claim 1, wherein the piston ring has a radial slit.

14. The disc stack centrifugal separator according to claim 1, wherein the height of the slot is greater than the height of the piston ring.

15. A disc stack centrifugal separator for separating a light fluid phase and a heavy fluid phase from a fluid feed mixture, the centrifugal separator comprising:

a housing;

a spindle;

a rotor; and a seal arranged between the spindle and the housing, wherein the spindle is journaled in the housing at a first axial end portion of the spindle and the rotor is connected to a second axial end portion of the spindle, wherein the spindle is only journaled in a bearing arrangement fixedly positioned in the housing at the first axial end portion, wherein the seal is arranged at a distance from the bearing arrangement where the spindle is subjected to deflection, and wherein the seal comprises a cylindrical inner surface associated with the housing, a circular slot in the spindle or in a rotating member associated with the spindle, and a piston ring arranged in the slot and abutting against the cylindrical inner surface, wherein the housing comprises a conical surface adjacent to the cylindrical inner surface.

16. The disc stack centrifugal separator according to claim 15, wherein the piston ring is stationary in a rotational direction of the spindle, and wherein the piston ring is axially movable along the cylindrical inner surface.

17. The disc stack centrifugal separator according to claim 15, wherein the piston ring is resilient and is biased outwardly against the cylindrical inner surface.

18. The disc stack centrifugal separator according to claim 15, wherein the rotating member associated with the spindle comprises a pulley, and wherein the slot is provided in the rotating member.

19. The disc stack centrifugal separator according to claim 15, wherein the piston ring is arranged adjacent to a first space inside the housing, the first space surrounding the spindle and being configured to contain an oil mist during operation of the centrifugal separator.

* * * * *